United States Patent [19]

Cobb et al.

[11] 4,046,505

[45] Sept. 6, 1977

[54] POST DYEING RESIN PARTICLES FIXED TO RESIN BASE

[75] Inventors: Malcolm Carnie Cobb; Pamela Elliott, both of Pontypool, England

[73] Assignee: Imperial Chemical Industries Limited, London, England

[21] Appl. No.: 276,294

[22] Filed: July 31, 1972

Related U.S. Application Data

[63] Continuation of Ser. No. 813,741, April 4, 1969.

[30] Foreign Application Priority Data

| | | |
|---|---|---|
| Apr. 8, 1968 | United Kingdom | 16855/68 |
| Aug. 16, 1968 | United Kingdom | 39269/68 |

[51] Int. Cl.[2] ..... D06P 1/52

[52] U.S. Cl. ..... 8/18 R; 8/4; 8/14; 8/15; 8/31

[58] Field of Search ..... 8/17, 18; 117/25, 38 R, 117/13

[56] References Cited

U.S. PATENT DOCUMENTS

| | | | |
|---|---|---|---|
| 2,153,755 | 4/1939 | Higgins | 117/25 |
| 2,297,691 | 10/1942 | Carlson | 17/25 X |
| 2,582,132 | 1/1952 | Kaphan | 117/25 |
| 3,357,830 | 12/1967 | Bixby | 117/37 |
| 3,406,137 | 10/1965 | Terry | 260/28.5 |
| 3,432,250 | 3/1969 | Miller et al. | 8/29 |
| 3,444,809 | 5/1969 | Ohkubo et al. | 117/13 |
| 3,454,347 | 7/1969 | Leimbacher | 8/34 X |

*Primary Examiner*—Donald Levy

*Attorney, Agent, or Firm*—Cushman, Darby & Cushman

[57] ABSTRACT

The invention herein is applying thermoplastic particle to a substrate, heating to fix the particles to the substrate and subsequently dyeing the resulting product with a dye substantive to the thermoplastic particles.

3 Claims, No Drawings

POST DYEING RESIN PARTICLES FIXED TO RESIN BASE

This is a continuation of application Ser. No. 813,741, filed Apr. 4, 1969.

The present invention relates to dyeing. More particularly the invention relates to decorative effects in a wide range of structures and materials.

Throughout this specification the expression "structure" is to be interpreted as including filaments and films, knitted, woven or non-woven fibrous or fibrillated film assemblies, foils, sheets, webs or mouldings or any combination thereof derived from natural or partly or wholly synthetic homopolymers and copolymers or blends thereof, in combination with partly or wholly synthetic homopolymer and copolymer mouldings in the form of particles or fixed conglomerations thereof which may be dispersed or spread either in a pattern or at random either throughout the remainder of the structure or on its surface or in any combination thereof. Thus, in essence, the final structure may be seen to comprise at least two major component parts, which for convenience will be termed hereinafter substrate material and affixed matter. Amongst such polymers there may be mentioned natural and regenerated or saponified celluloses; natural and regenerated proteins; natural and regenerated inorganic substances, for example asbestos and glass; polyacrylics, polyamides, polyhydrocarbons, polyesters, polyethers, polyurethanes and polyvinyls.

Despite the existence of numerous techniques for producing differentially dyed and coloured decorative structures or materials there still remains a demand from a cheap yet simple and effective technique which is not only readily adaptable to a variety of materials but readily lends itself to the production of a variety of coloured patterns or decorative effects.

In the present invention the applicants have not only been able to meet this demand by taking advantage of the substantivity or non-substantivity of different dyestuffs to the various media to which they may be applied, but in doing so have found that a particularly attractive sparkle or glitter effect may be given to certain structures so treated.

Thus, the effect of using dyestuffs may be exploited by dyeing a substrate material/affixed matter structure comprising at least two different materials each possessing differing dyestuff receptivity with respect to the dyestuff or dyestuffs used.

When more than one dyestuff is to be used they may either be employed separately or in any combination, in order to suit the particular dyeing system.

Consequently, the invention provides for the application of at least one disperse dyestuff to a structure comprising at least one relatively polar material in combination with at least one relatively non-polar material.

Where the differences in polarity between the structure components are sufficiently large, differential colour effects may be obtained but in cases where the polarity differences are small, differential textural effects may alternatively be obtained, or by suitable combination of dyestuffs and materials both effects may be exploited.

In another embodiment the invention provides for the application of at least one anionic and/or cationic dyestuff to a structure comprising the combination of at least two relatively polar materials either or all of which may be modified in order to influence their receptivity with respect to the dyestuff or dyestuffs used.

Furthermore, combinations of each embodiment may be made in order to obtain multiple dyeing effects in the presence of both polar and non-polar materials using disperse, anionic and/or cationic dyestuffs.

In the application of the present invention any particular dyestuff or dyestuffs may of course be substantially non-substantive with respect to one or more structure components.

Accordingly, the present invention provides a decorative structure consisting of a substrate material and affixed matter as hereinbefore defined in which the affixed matter comprises discrete mouldable polymer particles in combination with the substrate material.

The invention also provides a process for producing a decorative structure consisting of a substrate material and affixed matter as hereinbefore defined which comprises applying to the substrate material a mouldable polymer which on contact therewith solidifies to form discrete polymer particles.

The invention also provides a decorative structure comprising mouldable polymer particles or fused conglomerations thereof in combination with a substrate material which may be differentially dyed to give an aesthetically pleasing effect.

Depending upon such factors as the temperature of the polymer particles on application to the substrate material and the number of applied particles per unit area of substrate material, solidified polymer particles may or may not be of similar size or shape.

When polymer particles are embedded in the body of the substrate material it is clearly desirable that their presence and effect, particularly after dyeing, should be discernible.

Normally, affixed matter is applied to the substrate material in an undyed condition, but in some instances it may be preferable to apply pre-dyed matter to the substrate material. Alternatively, suitable affixed matter, e.g. copolyamides, may be chemically modified prior to their application to a substrate material in order to change their inherent dyeing characteristics, e.g. in the case of polyamides, modification so that basic dyestuffs may be employed.

Preferably, the substrate material comprises knitted, woven or non-woven assemblies consisting of fibres derived from polyamides, e.g. polyhexamethylene adipamide or polycaprolactam and polyesters, e.g. polyethylene terephthalate.

Non-polar materials that have also been found to be effective in the practice of the present invention, besides those mentioned above include both silicone and/or hydrocarbon based varnishes.

When patterned or other effects are to be produced on the surface of a material prior to dyeing by applying thereto a substance or substances of different dyestuff receptivity with respect to the substrate material, it or they may for convenience be applied to the substrate material in the form of a liquid or solid particle spray with or without the aid of a stencil.

One way in which such a particle spray may be applied to a substrate material is by the use of an electrostatic charging device whereby the particles themselves may be charged with respect to the substrate material, thus improving the efficiency with which particles may be dispersed and applied to the substrate. Furthermore, by arranging beneath the substrate electrically conducting materials connected to earth, particles can be caused to spread themselves over the substrate material according to the location of the conducting devices placed beneath.

Such a technique of particle spraying is also readily applicable to discrete fibres in the form of flock.

Alternatively, where a polymeric powder is to be deposited directly onto a substrate material, the use of a vibrating sieve has been found effective.

In some instances it may be advantageous to coat the substrate material with an adhesive so that affixed matter is more easily held in its original deposited poisition.

In the following examples which are intended only to illustrate the present invention and are to be considered in no way limiting, the parts and percentages are by weight.

EXAMPLE 1

Selected parts of a plain warp knitted fabric comprising fibres derived from polyhexamethylene adipamide were coated, using a stencil, with a finely divided powder of polyethylene which had the following properties:

| | |
|---|---|
| Melting Point | 106° C |
| Melt Viscosity | 3,000 poises (210° C) |
| Particle Size Range | 250–850 microns. |

The coating was such that there were between 25 and 200 particles per square inch of the treated areas. The fabric was then placed on a pin frame and subjected to a dry heat treatment in an oven for 40 seconds at 215° C. On removal from the pin frame the fabric was seen to be covered, in the selected areas, with small colourless particles which being also clear, reflected light. The fabric was then dyed for 2 hours at the boil in a dyebath containing

| | |
|---|---|
| Fabric (total) | 150 parts |
| Serinyl Brilliant Scarlet RD (Colour Index Disperse Red 6) | 10 parts |
| Duranol Blue 2 G (C.I. Disperse Blue 24,C161515) | 2.5 parts |
| Water | 250,000 parts |

On drying, the fabric was observed to have been coloured a deep russet and that the polyethylene particles were a dark blue which adhered firmly to the fabric substrate and retained their glittering and light reflecting properties. The whole fabric had an aesthetically pleasing appearance.

EXAMPLE 2

This example was similar to example 1 except that Serinyl Brilliant Scarlet RD was replaced by

| | |
|---|---|
| Nylomine Red A-2BS (C.I. Acid Red 266,C160880) | 7.5 parts |
| Nylomine Orange A-GS (C.I. Acid Yellow 64) | 2.5 parts |

and that the dyeing operation was carried out in the presence of 50 parts of acetic acid.

After drying, the fabric and polyethylene particles were found to have been coloured as in that example.

EXAMPLE 3

In this example the polyethylene powder of Example 1 was replaced with a copolyamide consisting of 78% hexamethylene dodecanoamide, 18% polyhexamethylene adipamide and 4% of the disodium salt of 9,9-bis (2[1] carbonamido ethyl) fluorene 2,7 disulphonic acid, possessing the following properties:

| | |
|---|---|
| Melting point | 180° C |
| Melt Viscosity | 50 poises (210° C) |

After coating and heat setting as in Example 1, dyeing was carried out for 2 hours at the boil in a dyebath containing

| | |
|---|---|
| Fabric | 150 parts |
| Astrazone Blue FGL (C.I. Basic Blue 44) | 5 parts |
| Naphthalene Red EA (C.I. Acid Red 13,C116045) | 10 parts |
| Acetic Acid | 50 parts |
| Water | 250,000 parts |

After drying, the background fabric was seen to be a bright clear red and the small particles of copolyamide, which adhered well to the fabric substrate were a glittering blue.

Some compositions of copolyamide have a tendency to become opaque in boiling water. This can be avoided by altering the formulation empirically.

EXAMPLE 4

This example was similar to Example 3 except that the plain nylon warp knitted fabric was replaced by a brushed or raised loop nylon fabric, that the copolyamide polymer powder was scattered on its surface in a random manner, and that the dyes mentioned were replaced by:

| | |
|---|---|
| Astrazone Red GTL (C.I. Basic Red 18) | and Solway Blue BN (C.I. Acid Blue 45,C163010) |

In the final dyed and dried fabric the colours mentioned in Example 3 were revered.

EXAMPLE 5

This example was similar to Example 4 except that the copolyamide polymer powder was scattered on the surface of the raised loop nylon fabric by means of an apparatus in which the powder was first propelled by air to an orifice which was held at 90 kv with respect to earth, where it acquired an electrostatic charge. The charged particles were attracted to the fabric but particularly strongly to areas of the fabric immediately below which had been placed earthed metal plates arranged in a pattern.

The fabric with powder coated as a replica of the pattern of the underlying metal plates was heat treated to cause the powder to adhere strongly and then dyed.

The result was a glittering red pattern, a replica of the pattern of the metal plates, on a blue background.

EXAMPLE 6

A piece of plain warp knitted fabric comprising fibres derived from polyethylene terephthalate was treated with two copolymer powders A and B. A, as described in Example 3 and B comprising 79% hexamethylene dodecanoamide, 19% hexamethylene adipamide and 2% hexamethylene diamine.

After the heat treatment the fabric (150 parts) was dyed for 2 hours at the boil in a dye bath containing

| | |
|---|---|
| Astrazone Blue FGL (C.I. Basic Blue 44) | 5 parts |
| Naphthalene Red EA (C.I. Acid Red 13) | 5 parts |
| Acetic Acid | 50 parts |
| Water | 250,000 parts |

After drying, the fabric was a very pale blue whereas the particles of copolymer A were bright blue and those of copolymer B bright red.

EXAMPLE 7

A woven fabric comprising fibres derived from cellulose triacetate when treated according to the method of Example 6 have very similar results, except that the background fabric was less stained with the cationic dye. The whole effect was aesthetically pleasing.

EXAMPLE 8

In this example the triacetate fabric of Example 7 was replaced with a woven cotton fabric which gave similar results.

EXAMPLE 9

In this example the triacetate fabric of Example 7 was replaced with a piece of white cellulose cardboard, and the duration of the heat setting treatment was increased to 60 seconds. After a dyeing process similar to that described in Example 6, the copolymer particles which adhered well were seen to be brightly coloured, copolymer A being blue and copolymer B red.

EXAMPLE 10

A 36 inch wide warp knitted fabric, prepared from 40 denier, 13 filament yarn derived from polyhexamethylene adipamide and brushed to form a raised loop pile, was fed onto the pin tracks of a Dalglish FG 668 stenter. Before the fabric entered the hot zone, polyethylene powder-Alkathene (Registered Trade Mark) 19300, was scattered randomly over the fabric surface. The fabric, travelling at 5 yards per minute passed into the hot zone which was kept at 220°-225° C. The fabric was set and the polyethylene powder melted and fixed in this one step. The fabric (150 pts) was dyed for 2 hours at the boil in a dyebath containing

| | |
|---|---|
| Serinyl Brilliant Scarlet RD (C.I. Disperse Red 6) | 10 pts. |
| Duranol Blue 2G (C.I. Disperse Blue 24) | 2.5 pts. |
| Water | 15,000 pts. |
| Liquor to goods ratio 100 : 1 | |

The result was a dark red fabric background with the affixed polyethylene being clear blue. A ladies evening blouse made from this fabric was considered aesthetically pleasing.

EXAMPLE 11

A warp knitted fabric, prepared from 40 denier, 13 filament yarn derived from polyhexamethylene adipamide was fed onto the pin tracks of a Dalglish FG668 stenter, which had been fitted with a GEC electrically powered infra red fabric setting device. The latter was used in place of the Dalglish hot air setter but was adjusted to give the same setting effect on the fabric. Before the fabric entered the setting zone, the two copolyamide powders, A and B used in Example 6, were applied in turn to the fabric; the area of application being controlled by stencils. The powder application was carried out by means of an apparatus consisting of a sieve which was caused to vibrate by an electromagnetic tranducer. After setting, the coated fabric was dyed as in Example 6 but with a reduced liquor : goods ratio (i.e. 100:1) and the acetic acid (50 pts.) replaced by ammonium acetate (50 pts.)

The result was a pattern of red and blue areas which sparkled in reflected light on an almost undyed background fabric. The patterns of the stencils were faithfully reproduced.

EXAMPLE 12

A piece of warp knit fabric comprising fibres derived from polyhexamethylene adipamide and brushed so as to cause a raised loop pile surface was treated in partly overlapping areas with copolymer powders C and D, where C consisted of a copolymer containing hexamethylene diammonium sebacate 70 pts., caprolactam 30 pts. and hexamethylene diamine 2 pts. The melting point of copolymer C was 175°-180° C. Copolymer D consisted of hexamethylene diammonium sebacate 80 pts., caprolactam 20 pts., and the disodium salt of 9,9-bis (2' carbonamido ethyl) fluorene 2,7 disulphonic acid 4 pts. The melting point of copolymer D was 170°-175° C.

After heat setting for 50 seconds at 215° C. in an air oven the treated fabric was dyed in a bath containing

| | |
|---|---|
| Astrazone Orange RRL (C.I. Basic Orange 28) | and Solway Blue BN (C.I. Acid Blue 45) |

for 1 hour at the boil in the presence of ammonium acetate (pH 6).

Copolymer powder C was coloured bright blue and copolymer D, bright orange. Both retained their particulate form and sparkled in light. The overlap of the two copolymers provided an area of, apparently, a third colour. The background fabric was not significantly coloured and the whole effect was aesthetically pleasing.

EXAMPLE 13

A panel of woven fabric composed of 60 denier, 20 filament yarn derived from polycaprolactam to which a random application of polyethylene powder - Alkathene (Registered Trade mark) 19300, had been made, was heat set in an air oven at 185° C. for 60 seconds. The dyeing was carried out as in Example 1 except that the Serinyl Brilliant Scarlet RD was replaced with Dispersol Fast Yellow A (C.I. Disperse Yellow 1, C110345).

The woven fabric was dyed a greenish yellow and the affixed polyethylene, which glittered in reflected light, a medium blue.

EXAMPLE 14

A panel of woven fabric composed of 60 denier, 20 filament yarn derived from polycaprolactam was coated lightly in separate areas with copolyamide powders E and F, each with a melting point of 155° C. Copolymer E consisted of 69% 10-amino undecanoic acid, 29% hexamethylene diammonium adipate and 2% hexamethylene diamine, while copolymer F comprised 79% 10-amino undecanoic acid, 19% hexamethylene diammonium adipate and 2% disodium salt of 9,9-bis (2' carbonamido ethyl) fluorene 2,7 disulphonic acid.

After heat setting at 185° C. for 60 seconds the coated fabric was dyed by the method described in Example 3 except that the pH was controlled by 50 parts of ammonium acetate in place of the acetic acid.

The fabric was only slightly coloured whereas polymer E was bright red and polymer F bright blue. Both species of polymer sparkled in reflected light.

What we claim is:

1. A process for producing a decorative structure which comprises applying thermoplastic polymer particles to a polymeric substrate material having a different dye substantivity from said particles, heating to fix the particles to said material and subsequently dyeing the resulting product to colour the polymer particles and give the same a different colour effect from said substrate material.

2. A process according to claim 1 in which the decorative structure is dyed with a disperse dyestuff, a cationic dyestuff or an anionic dyestuff or any combination of these dyestuffs.

3. A process according to claim 2 wherein said substrate material comprises a polyamide fabric and said fabric is heat set simultaneously with the fixing of said particles thereto.

* * * * *